United States Patent [19]

Timm et al.

[11] Patent Number: 4,806,211

[45] Date of Patent: Feb. 21, 1989

[54] ALUMINUM ALLOY PRODUCT WITH UNIFORMLY GREY, LIGHT-FAST SURFACE AND PROCESS FOR ITS MANUFACTURE

[75] Inventors: Jürgen Timm, Steisslingen, Fed. Rep. of Germany; Jean-Francois Paulet, Siblingen, Switzerland; Jörg Maier, Engen, Fed. Rep. of Germany

[73] Assignee: Swiss Aluminum Ltd., Chippis, Switzerland

[21] Appl. No.: 48,802

[22] Filed: May 12, 1987

[30] Foreign Application Priority Data

May 14, 1986 [CH] Switzerland ..... 1956/86

[51] Int. Cl.[4] ..... C25D 11/04; C25D 5/44; C22C 21/00

[52] U.S. Cl. ..... 204/29; 204/58; 420/550; 428/469; 428/472.2

[58] Field of Search ..... 204/58, 29; 420/550; 428/469, 472.2

[56] References Cited

U.S. PATENT DOCUMENTS 4,672,022 6/1987 Reiss et al. ..... 420/550 X

*Primary Examiner*—John F. Niebling
*Assistant Examiner*—John S. Starsiak, Jr.
*Attorney, Agent, or Firm*—Bachman & LaPointe

[57] ABSTRACT

An anodized aluminum product prepared by anodizing an alloy comprising 1.20–1.60% iron and 0.25–0.55% manganese with a weight ratio of iron to manganese between 2.8 and 5, up to 0.20% silicon, up to 0.30% copper, up to 5% magnesium, up to 0.10% chromium, up to 2% zinc, up to 0.25% zirconium, up to 0.10% titanium, remainder aluminum and in total up to 0.50% of other by anodic oxidation in an electrolyte at a temperature of less than 560° C. for no more than 4 hours so as to produce an oxide thickness of 5 to 30 μm.

8 Claims, No Drawings

ALUMINUM ALLOY PRODUCT WITH UNIFORMLY GREY, LIGHT-FAST SURFACE AND PROCESS FOR ITS MANUFACTURE

BACKGROUND OF THE INVENTION

The invention relates to aluminum alloy products in the form of extruded sections or cold rolled sheets having uniformly grey, light-fast surface and a light reflectivity of at most 50 % as a result of anodizing in an electrolyte. The invention also embraces a process for manufacturing these products.

Various processes are known for achieving a decorative grey color tone on aluminum alloy products; these processes are based on anodic oxidation and do not require additional adsorptive coloring. The resultant color tone is determined by a plurality of process parameters, in particular the composition of the electrolyte, the applied voltage, the type of electric current, density and duration and also the composition of the alloy.

The two stage electrolyte coloring processes represent a many and varied group of processes. In a first stage, an oxide layer about 20 μm thick is produced in a sulphuric acid or sulphuric acid/oxalic acid electrolyte using direct electric current and a current density of 100–200 A/m$^2$. Following that, in a second stage, using alternating current and a current density of 10–150 A/m$^2$ in a metal salt solution of suitable composition, metal compounds are precipitated out and deposited such that the said compounds adhere to the base of the pores in the oxide layer thus forming permanent light-fast coloring of the oxide.

A further group of processes for producing light-fast grey tone finish makes use of single stage color anodizing in which direct current at a current density of 70–800 A/m$^2$ is applied in a special electrolyte to produce oxide layers of natural self-color tone. The color tone obtained depends on the composition of the alloy and on the electrolyte comprising organic acids, if desired with addition of sulphuric acid. The materials used are usually aluminum alloys of the type AlMn, AlMg and AlMgSi.

Using specially selected alloys and observing special procedures in the production of the semi-finished product it is possible to obtain decorative grey tones also with standard anodizing processes. These widely known, cost-attractive anodizing processes employ direct-current at a current density of 80–300 A/m$^2$ and make use of a sulphuric acid electrolyte, often containing additions of carbonic acid. An aluminum alloy known to date in this connection contains 4.5% silicon and 0.5% magnesium. Using a current density of 150 A/m$^2$, one obtains with that alloy after 40 minutes of treatment an oxide layer which is about 18 μm thick and exhibits a moderately grey color tone. The light reflectivity, as a measure of the grey tone, amounts to 20%. After an oxidation time of 60 minutes, the oxide layer is 27 μm and exhibits a dark grey, self color finish having a reflectivity of 13%. The reflectivity here was measured in each case using a LANGE UME 1-LFE 1-measuring instrument.

During the production of the semi-finished product, this alloy, however, tends to result in excessive wear on the shaping tools. Furthermore, it is very difficult to maintain close tolerances in color tone and uniformity.

SUMMARY OF THE INVENTION

The object of the present invention is to develop aluminum alloy products of the kind described above and to develop a process for their manufacture which makes it possible to obtain a uniform, structure-free, light-fast grey surface of at most 50% light reflectivity using the conventional anodizing processes, without an additional coloring step. Furthermore, it should be possible to obtain a wide range of grey color tones using a constant alloy composition.

DETAILED DESCRIPTION OF THE INVENTION

The foregoing object is achieved by way of the invention in that the alloy contains 1.20–1.60% iron, 0.25–0.55% manganese in a weight ratio of iron to manganese of 2.8–5, up to 0.20% silicon, up to 0.30% copper, up to 5% magnesium, up to 0.10% chromium, up to 2% zinc, up to 0.25% zirconium, up to 0.10% titanium, the rest aluminum and in total up to 0.50% other elements, such that the light-reflectivity, with constant alloy composition, is adjustable to be 8–45% with oxide thicknesses of 5–30 μm, and below 30% with an oxide thickness of 10 μm.

Also within the scope of the invention is a process for manufacturing these aluminum alloy products with uniformly grey, light-fast surface finish having a light reflectivity of at most 50%, by anodic oxidation in an electrolyte, in which process all treatment temperatures used with an alloy containing 1.20–1.60% iron, 0.25–0.55% manganese in a weight ratio of iron to manganese of 2.8–5, up to 0.20% silicon, up to 0.30% copper, up to 5% magnesium, up to 0.10% chromium, up to 2% zinc, up to 0.25% zirconium, up to 0.10% titanium, the rest aluminum and in total up to 0.50% other elements, from the casting stage to the product stage, are below 560° C. and such that the duration of treatment in the temperature range 540°–560° C. amounts at most to 4 hours.

Preferred are all heat treatment temperatures, both these relating to the hot forming processes and those preceding hot forming, that are in the lowest possible range for the processing in question; also the duration at temperatures above 300° C. is to be kept as short as possible.

It has been found favorable to keep the iron content in the alloy employed between 1.30 and 1.50 %, the weight ratio of iron to manganese between 3 and 4 and the silicon content below 0.08%; this makes it possible to obtain uniformly dark grey tones also with relatively thin oxide layers.

An advantageous version is such that the anodic oxidation is performed using direct electric current in a sulfuric acid electrolyte containing 10–25 wt-% sulfuric acid and up to 5% carbonic acid.

Before anodizing, the surface of the aluminum item can be pretreated by grinding, brushing, polishing, etching, brightening and the likes.

As a result of the process according to the invention it is now possible to manufacture those cold rolled sheets and extruded sections that, without having to vary the alloy, after standard anodizing treatment offer a range of grey tones having a light reflectivity of 8–45% with an oxide layer thickness of 5–30 μm and with an oxide layer thickness of 10 μm have a light reflectivity of less than 30%.

Further advantages, features and details of the invention are revealed in the following description of preferred examplified embodiments.

EXAMPLE NO. 1

A rectangular strand measuring 320×1080 $mm^2$ in cross-section was cast in an alloy containing 1.42% iron, 0.44% manganese, 0.06% silicon, the remainder aluminum and 0.07% impurities. The conventionally cast ingot was scalped on both sides to a depth of 10 mm. If hot-top or magnetic mold casting is employed, the scalping could be omitted. The slab was then heated to 520° C. and, without holding at temperature, transferred to a hot rolling mill and rolled to an 8 mm thick plate. The said plate emerging from the mill at 450° C. was passed through a water bath, then cold rolled down to a thickness of 1.0 mm. After a final anneal of 3 hours at 320° C., the sheet exhibited an ultimate tensile strength $R_m$ of 142 MPa, a 0.2% proof stress $R_{p0.2}$ of 104 MPa and an elongation $A_5$ of 40%.

Sheets measuring 980×980 $mm^2$ were anodized in an electrolyte. The bath contained 180 g sulfuric acid and 10 g oxalic acid per liter. The density of the direct-current was 150 $A/m^2$. The oxide layer exhibited a uniform, mid-grey color over the whole surface. The light reflectivity measured, using the LANGE UME 1-LFE 1 device, amounted to 21%. Sheets anodized for 40 minutes exhibited an oxide layer thickness of 20 μm; the light reflectivity of the uniform, dark grey surface was 12%.

EXAMPLE NO. 2

A round ingot, 200 mm in diameter, was cast in an alloy containing 1.45% iron, 0.43% manganese, 0.15% zirconium, 0.05% silicon, the remainder aluminum with 0.04% impurities. The ingot was machined to a depth of 2 mm around its circumference. It was then heated quickly to 490° C. for extrusion and without delay extruded to three sections each having a crosssection of 140 $mm^2$. The extruded strands, which contained extrusion welds, emerged from the die at a temperature of 540° C. and were cooled with forced air cooling. Tensile testing showed the tensile strength $R_m$ to be 160 MPa and the 0.2% proof stress $R_{p0.2}$ to be 85 MPa.

Extrusion lengths were anodized in a bath containing 180 g sulfuric acid and 10 g oxalic acid per liter using a directcurrent with current density of 200 $A/m^2$. After 13 minutes treatment, the oxide was 9 μm thick. The reflectivity was 20%. All three sections exhibited a uniform, structure-free, mid-grey color. There were no color differences apparent.

EXAMPLE NO. 3

A round ingot, 160 mm in diameter, was cast in an alloy containing 1.48% iron, 0.40% manganese, 1.2% magnesium, 0.05% silicon, the remainder aluminum with 0.04% impurities. The ingot was machined to a depth of 3 mm at its circumference, heated quickly to 380° C. for extrusion and after holding at temperature for one hour was extruded to a rectangular section of 4×30 $mm^2$ at a speed of 16 m/min. The extruded strand emerged from the die at a temperature of 460° C. and was cooled in the air. The tensile strength $R_m$ was 215 MPa, the 0.2% proof stress $R_{p0.2}$ was 106 MPa and the elongation at fracture $A_5$ was 21%. After stretching 3%, the $R_m$ value was 220 MPa, $R_{po.}2$ was 173 MPa and A5 was 19 %.

Lengths of the extrusion were anodized in a bath containing 180 g sulfuric acid and 10 g oxalic acid per liter using a direct-current of current density 150 $A/m^2$. After 25 minutes of treatment, the oxide layer was 12 μm thick. The reflectivity was 18 1 %.

EXAMPLE NO. 4

Extruded sections from example No. 2 were anodized at 25° C. in an aqueous bath containing 75 g sulfo-salicylic acid, 50 g tartaric acid and 5% sulfuric acid per liter using a direct-current at a current density of 150 $A/m^2$. The oxide layer was 9 μm thick after 25 minutes of treatment. The reflectivity of the dark grey surface was 12%.

EXAMPLE NO. 5

Extruded sections from example No. 2 were anodized at 20° C. in a bath containing 160 g sulfuric acid and 20 g glycerine per liter for 40 minutes under the application of direct-current at a current density of 150 $A/m^2$. The thickness of the resulting oxide was 22 μm, the reflectivity 11%.

EXAMPLE NO. 6

Extruded sections from example No. 2 were anodized at 20° C. in a bath containing 200 g sulfuric acid per liter for 20 minutes. The current density was alternated with a frequency of 25 hz between two levels v.z., 150 and 200 $A/m^2$ in each case with a duration of 20 ms at each level. The result oxide layer measured 12 μm and exhibited a reflectivity of 16%.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An anodized aluminum alloy product having a uniformly grey, light fast surface and a light reflectivity of no more than 50 percent prepared by anodizing an aluminum alloy which consists essentially of 1.20 to 1.60 wt. % iron and 0.25 to 0.55 wt. % manganese wherein the wt. ratio of iron to manganese is between 2.8 to 5.0, up to 0.20 wt. % silicon, up to 0.30 wt. % copper, up to 5.00 wt. % magnesium, up to 0.10 wt. % chromium, up to 2.00 wt. % zinc, up to 0.25 wt. % zirconium, up to 0.10 wt. % titanium, up to 0.50 wt. % other elements, balance aluminum wherein said anodized aluminum alloy product has an oxide thickness of 5 to 30 μm.

2. A product according to claim 1 wherein said product is prepared by extrusion.

3. A product according to claim 1 wherein said product is prepared by cold rolling.

4. A product according to claim 1 wherein said iron content is between 1.30 to 1.50 wt. %, said silicon content is up to 0.08 wt. % and the weight ratio of iron to manganese is between 3 to 4.

5. A process for manufacturing an anodized aluminum alloy product having a uniformly grey, light fast surface and a light reflectivity of no more than 50 percent comprising providing an aluminum alloy which consists essentially of 1.20 to 1.60 wt. % iron and 0.25 to 0.55 wt. % manganese wherein the wt. ratio of iron to manganese is between 2.8 to 5.0, up to 0.20 wt. % silicon, up to 0.30 wt. % copper, up to 5.00 wt. % magnesium, up to 0.10 wt. % chromium, up to 2.00 wt. % zinc, up to 0.25 wt. % zirconium, up to 0.10 wt. % titanium, up to 0.50 wt. % other elements, balance aluminum, casting said alloy, heat treating said cast alloy for further processing to final product wherein the heat treatment temperature is no more than 560° C. for a time of no more than 4 hours and thereafter anodizing said heat treated alloy in an electrolyte wherein said anodized aluminum alloy product has an oxide thickness of 5 to 30 μm.

6. A process according to claim 5 wherein said iron content is between 1.30 to 1.50 wt. %, said silicon content is up to 0.08 wt. % and the weight ratio of iron to manganese is between 3 to 4.

7. A process according to claim 5 wherein said heat treatment temperature is between 540° and 560° C.

8. A process according to claim 5 including anodizing using direct current in an electrolyte comprising 10 to 25 wt. % sulfuric acid and up to 5 wt. % carbonic acid.

* * * * *